United States Patent [19]

Minami

[11] Patent Number: 4,611,144

[45] Date of Patent: Sep. 9, 1986

[54] X-RAY IMAGE TUBE

[75] Inventor: Hiroshi Minami, Yokohama, Japan

[73] Assignee: Kabushiki Kaisha Toshiba, Kawasaki, Japan

[21] Appl. No.: 719,540

[22] Filed: Apr. 3, 1985

[30] Foreign Application Priority Data

Apr. 6, 1984 [JP] Japan ..... 59-68465

[51] Int. Cl.[4] ..... H01J 35/14

[52] U.S. Cl. ..... 313/373; 250/213 VT; 313/530

[58] Field of Search ..... 313/373, 382, 442, 526, 313/530, 541, 544; 250/213 VT

[56] References Cited

U.S. PATENT DOCUMENTS 3,697,795 10/1972 Braun et al. ..... 313/530

3,784,830 1/1974 Schwierz et al. ..... 250/213 VT

*Primary Examiner*—Stewart J. Levy

*Assistant Examiner*—Joseph W. Roskos

*Attorney, Agent, or Firm*—Cushman, Darby and Cushman

[57] ABSTRACT

An X-ray image tube has a vacuum envelope, a photocathode arranged at an input side in the vacuum envelope and having a curved surface open to an output side thereof, and a phosphor screen arranged at an output side in the vacuum envelope and having a surface on which electrons emitted from the photocathode are electrooptically focused. The photocathode consists of a central surface region with a diameter which is ½ to 4/5 of the diameter of the photocathode and a peripheral surface region. The central surface region has a profile such that an increment of the meridional curvature radius from the center to a peripheral portion thereof is larger than a constant derived from a linearity between the increment and a distance from the axis of the photocathode. The peripheral surface region has a profile such that an increment of the meridional curvature radius from an inner peripheral portion to an outer peripheral portion is smaller than the constant derived from a linearity between the increment and the distance from the axis of the photocathode.

5 Claims, 4 Drawing Figures

X-RAY IMAGE TUBE

BACKGROUND OF THE INVENTION

I. Field of the Invention

The present invention relates to an X-ray image tube and, more particularly, to an X-ray image tube wherein a photocathode having different curvature radii at its central and peripheral surface regions is arranged at an input side of an evacuated envelope.

II. Description of the Prior Art

X-ray image tubes have been widely used to obtain X-ray images for medical diagnosis. A photocathode having a spherical or hyperbolic curved surface is used in a conventional X-ray image tube using an electron-optical focusing system.

A focusing surface of electrons emitted from this photocathode is not a flat surface but a curved surface with a considerably large curvature radius. An image on an output phosphor screen of the X-ray image tube is picked up by a television camera or an optical camera through an optical lens system. In addition to this reason, in order to simplify the fabrication of output phosphor screens, the output phosphor screen has a flat surface. When the focusing surface of the electrons from the photocathode is deviated from the flat surface, the focusing state of the output phosphor screen becomes poor. The resolution of the image formed on the output phosphor screen is degraded.

Assume that the photocathode has a spherical surface. When an X-ray image tube has its entire photocathode surface as an input field of view, the focusing surface becomes a relatively flat surface, and a good resolution can be obtained. However, an object is observed mainly from a central surface region of the input field of view. For example, when the entire input field of view of the photocathode has a diameter of 320 mm, a surface region having a diameter of 160 mm or 230 mm is frequently enlarged to a size corresponding to that of the entire input field of view. In this case, a trajectory of electrons emitted from the peripheral surface region of the input field of view having the diameter of 160 mm or 230 mm passes outside that of the electrons emitted from the peripheral surface region of the entire input field of view at the anode side of the electron lens system, thereby increasing the focusing action on the electron beams. As a result, when that surface region of the photocathode which has the diameter of 160 mm or 230 mm is enlarged and the image is picked up, the focusing surface of this region deviates from the flat output phosphor screen, thus degrading the resolution. In this case, when a photocathode has a hyperbolic curved surface whose opening extends toward the output side, the trajectory of the electrons in the peripheral surface region comes closer to be parallel to the axis of the electron lens. As a result, the trajectory of the electrons passes inside that of the electron beams emitted from the peripheral surface region of the entire input field of view. For this reason, the focusing action on the electrons is weakened, and the focusing surface of the region having the diameter of 160 mm or 230 mm becomes flat, thereby improving the resolution.

However, when the photocathode has a hyperbolic curved surface and an image of the entire input field of view is picked up, the trajectory of electrons emitted from the peripheral surface region of the entire input field of view comes close to be parallel to the axis of the electron lens. Therefore, the trajectory of the electrons passes through the peripheral surface region at the cathode side of the electron lens system. The beams are strongly focused, and the focusing surface of the entire input field of view greatly deviates from the output phosphor screen, thus degrading the resolution. Thus, when the photocathode of the type described above is used, the entire surface of the photocathode cannot be used as the effective field of view.

As described above, when the photocathode comprises a spherical surface and the entire surface thereof is used as an input field of view, a good resolution can be obtained. In order to observe an image in more detail, when only the central surface region of the photocathode is enlarged to focus an image on the phosphor screen, the image greatly deviates from the focusing surface, degrading its resolution. In order to reduce the error of the focusing surface when only the central surface region is enlarged and focused, a meridional curvature radius of a cross section of the photocathode is increased from the central surface region to the peripheral surface region like in a hyperbolic curved surface but unlike a predetermined spherical surface. When a surface is used such that an increment of the meridional curvature radius is larger than a constant derived from a linearity between the increment and a distance from the central surface region, a good resolution can be obtained in the case wherein the central surface region is enlarged and focused. However, when the entire surface of the photocathode is used as the input field of view, the resolution in the peripheral surface region is greatly degraded.

SUMMARY OF THE INVENTION

It is an object of the present invention to provide an X-ray image tube wherein a focusing surface is substantially flat even if an entire surface of a photocathode is used as an input field of view or a central surface region of the photocathode is used as the input field of view, thereby greatly improving the total resolution of an image.

The X-ray image tube comprises: a vacuum envelope; a photocathode arranged at the input side in the vacuum envelope and having a curved surface open to the output side thereof; and a phosphor screen arranged at the output side in the vacuum envelope and having a surface on which electrons emitted from the photocathode are electrooptically focused. The photocathode comprises a central surface region with a diameter which is $\frac{1}{2}$ to 4/5 of the diameter of the photocathode and a peripheral surface region surrounding it. The central surface region has a profile such that an increment of the meridional curvature radius from the center to a peripheral portion thereof is larger than a constant derived from a linearity between the increment and a distance from the axis of the photocathode. The peripheral surface region has a profile such that an increment of the meridional curvature radius from an inner peripheral portion to an outer peripheral portion is smaller than the constant derived from a linearity between the increment and the distance from the axis of the photocathode.

The central surface region can comprise a hyperboloid. The peripheral surface region can comprise a spherical or elliptic surface. In this case, the spherical surface is defined as a surface such that an increment of the meridional curvature radius is zero, i.e., that the curvature radius is constant. The elliptic surface is defined as a surface such that an increment of the meridional curvature radius is negative, i.e., that the meridional curvature radius is continuously decreased.

It is preferable that the central surface region is tangentially connected to the peripheral surface region.

According to the present invention, the following effect can be provided. In the conventional X-ray image tube, the resolution is degraded when the entire surface of the photocathode serves as the input field of view or the central surface region thereof serves as the input field of view. As a result, no conventional X-ray tube provides good resolution in both cases. However, the X-ray image tube of the present invention can provide narrow and wide fields of view and can be suitably used for an X-ray diagnosis apparatus in medical applications.

DETAILED DESCRIPTION OF THE PREFERRED EMBODIMENT

Figure 1:
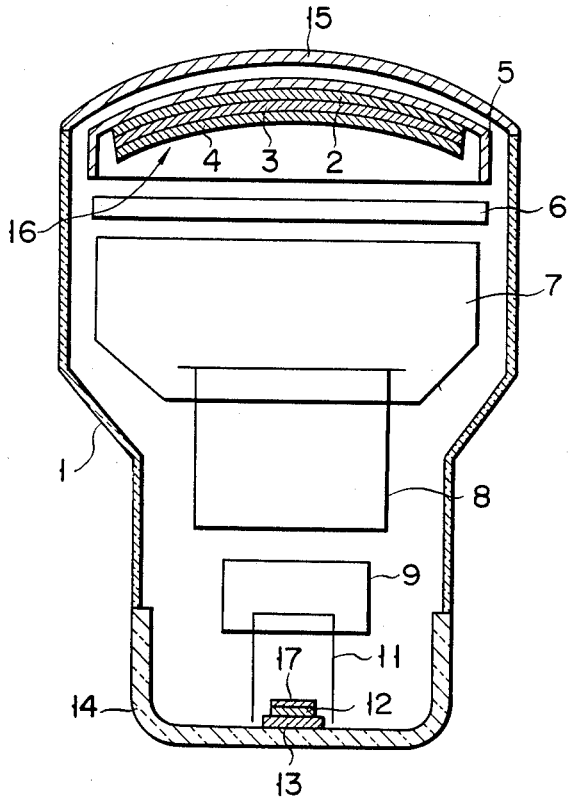
FIG. 1 is a sectional view of an X-ray image tube according to an embodiment of the present invention.

When a central region of a field of view of an X-ray image is enlarged and observed, a central region of a photocathode, i.e., a region with a diameter which is ½ to 4/5 of the diameter of the photocathode is used. The trajectory of electrons emitted from a peripheral portion of such a region substantially passes through a central region of an electron lens at the cathode side. However, the trajectory passes through the peripheral region of the electron lens at the anode side. As a result, electrons emitted from the peripheral portion of the central region of the photocathode are subjected to a focusing action stronger than that of electrons emitted from the center of the central region.

According to the present invention, an increment of the meridional curvature radius from the center to the peripheral portion of the central region in a profile of the photocathode is larger than a constant derived from a linearity between the increment and a distance from the axis of the photocathode. For example, the central region comprises a hyperbolic surface. The trajectory of electrons emitted from the peripheral portion of the central region of such a photocathode passes through the central region of the electron lens at the anode side, unlike the case wherein the central region comprises a spherical surface. Therefore, the focusing action is not too strong. As a result, the focusing surface of the overall central region is close to the plane of a phosphor screen, resulting in good resolution in the entire surface of the central region.

Assume that the entire surface of the photocathode is utilized to observe the entire region of the input field of view. In this case, the trajectory of electrons emitted from a peripheral region of the photocathode, i.e., a portion outside the region having a diameter which is ½ to 4/5 of the diameter of the photo-cathode, passes through the peripheral region of the electron lens at the cathode side. As a result, the electrons in this case are subjected to a strong focusing action.

According to the present invention, an increment of the meridional curvature radius from the inside edge to the outside edge of the peripheral region in a profile of the photocathode is smaller than a constant derived from a linearity between the increment and a distance from the axis of the photocathode. For example, the peripheral region comprises a spherical surface or an elliptic surface. It must be noted that when the peripheral region comprises an elliptic surface, the curvature radius of a profile of the elliptic surface is decreased from a contact point with the minor axis toward that with the major axis thereof. Therefore, the peripheral region must comprise a portion with a profile having an elliptic surface near the minor axis. In this case, it is preferable that the central region of the photocathode is tangentially connected to the peripheral region thereof so that the tangent at the contact portion is common to both regions. The electrons emitted from the peripheral region of such a photocathode are directed toward the axis of the electron lens, unlike the case wherein the photocathode comprises a hyperbolic surface. The trajectory of the electrons passes through the vicinity of the center of the electron lens at the cathode side. The focusing action applied to the electrons is weak. As a result, the focusing surface of the entire photocathode is close to the plane of the phosphor screen, resulting in good resolution in the entire photocathode.

As has been described above, according to the X-ray image tube of the present invention, good resolution is ensured both in the case where the entire region of an input field of view is observed and the case where a central region of the input field of view is enlarged and observed.

The present invention will now be described in detail with reference to preferred examples.

Referring to the X-ray image tube of FIG. 1, reference numeral 1 denotes a vacuum envelope, and 15, an input window. The input window 15 is formed to project outwardly and comprises aluminum. The input window 15 can also be formed to be recessed inwardly and comprises titanium. An input screen 16 is arranged at an input side, i.e., in the vicinity of the input window 15, in the vacuum envelope 1. The input window 15 generally comprises an aluminum substrate 5, a phosphor screen 2, an intermediate layer 3, and a photocathode 4. The phosphor screen 2 is formed on the aluminum substrate 5 and comprises a cesium iodide, etc., which emits light upon the incidence of X-rays. The intermediate layer 3 is formed on the phosphor screen 2 to prevent the reaction between the phosphor screen 2 and the photocathode 4, and comprises an aluminum or indium oxide to impart conductivity to the photocathode 4. The photocathode 4 is formed on the intermediate layer 3.

Meanwhile, an anode 11 is arranged at the output side of the vacuum envelope 1, that is, in the vicinity of the output window 14. Focusing electrodes 6, 7, 8 and 9 are arranged between the anode 11 and the photocathode 4. The number of the focusing electrodes can vary from 1 to 5. An output phosphor screen 12 is arranged in the vicinity of the anode 11 and is adjacent to the output window 14. The output phosphor screen 12 emits light upon the incidence of electrons thereon and is formed on a glass substrate 13. A light-shielding conductive screen 17 comprising a thin aluminum film is formed on the phosphor screen 12. The glass substrate 13 can comprise either a transparent glass plate or an optical fiber plate.

Voltages of 0 V and 30 kV are applied to the photocathode 4 and the anode 11, respectively. The voltages applied to the focusing electrodes 6, 7, 8 and 9 differ when the entire surface of the photocathode is observed and when only the central region of the photocathode is observed. In both cases, the voltages are set to be between that of the photocathode 4 and that of the anode 11. The photocathode 4 has a diameter of 334 mm. The distance from the center of the photocathode 4 to the phosphor screen 12 is 407 mm.

Figure 2:
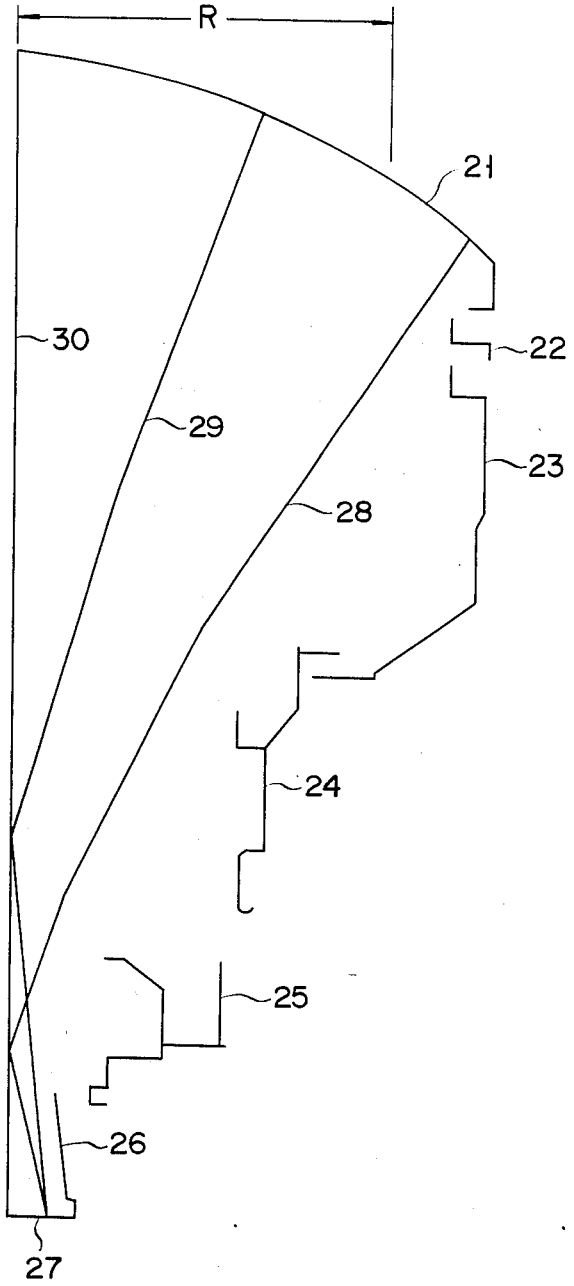
FIG. 2 is an enlarged sectional view of a main part of FIG. 1.

FIG. 2 is a diagram obtained by enlarging part of FIG. 1.

Referring to FIG. 2, reference numeral 21 denotes a photo-electron emitting surface of the photocathode 4; 22, 23, 24 and 25, focusing electrodes corresponding to the electrodes 6, 7, 8 and 9, respectively; 26, an anode corresponding to the anode 11; and 27, a phosphor screen corresponding to the screen 12. When the entire surface of the photocathode is observed, the photoelectrons emitted from the photocathode 21 pass along a trajectory 28 to reach the phosphor screen 27. A light image corresponding to the photoelectron image on the photocathode 4 is formed on the phosphor screen 27. Only when a central region of the photocathode is observed, the photoelectrons pass along a trajectory 29 to reach the phosphor screen 27. It should be noted that reference numeral 30 denotes the tube axis which corresponds to the trajectory of the electrons emitted from the central region of the photocathode 4.

Figure 3:
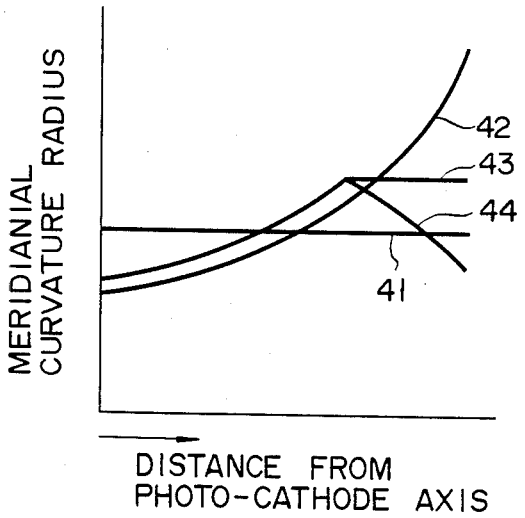
FIG. 3 is a graph wherein changes in a meridional curvature radius in sections of photocathodes of a conventional X-ray image tube and that according to the present invention are compared.

FIG. 3 is a graph showing a relationship between the distance from the axis of the photocathode and a meridional curvature radius of a curved surface thereof.

Referring to FIG. 3, a line 41 shows the case of a conventional photocathode having a spherical surface wherein the increment of the meridional curvature radius is 0 throughout the entire surface thereof. A curve 42 shows the case of another conventional photocathode having a hyperbolic surface wherein the increment of the meridional curvature radius is increased throughout the entire surface from the axis toward the outer periphery of the photocathode. In the case shown by a curve 43, a photocathode has a surface in which a central region with a diameter (twice the distance from the axis of the photocathode to the edge of the central region) which is 7/10 the diameter of the photocathode, comprising a hyperboloid. A peripheral region outside the central region has a spherical surface. In other words, the curve 43 shows a case of Example 1 of the present invention. In the case shown by a curve 44, the photocathode has a surface in which the central region has a diameter of 7/10 the diameter of the photocathode and comprises a hyperboloid as in Example 1. A peripheral region outside the central region has an elliptic surface in which the meridional curvature radius thereof is reduced as a function of the distance from the axis of the photocathode. In other words, the curve 44 shows a case of Example 2 of the present invention. In Examples 1 and 2, the curved surfaces at the central and peripheral regions have a common tangent at their boundary.

In the X-ray image tubes of Examples 1 and 2, when only the central region of the photocathode is observed, the trajectory 29 of electrons emitted from the peripheral portion in the central region of the photocathode passes through the vicinity of the center of the electron lens system at the anode side. Therefore, the difference in the focusing action is small compared with the case wherein electrons pass along the trajectory 30 as the central axis of the photocathode. The focusing surface of the entire central region is very close to the plane of the phosphor screen 27, resulting in good image resolution.

When the entire surface of the photocathode is observed, the trajectory 28 of electrons emitted from the peripheral region of the photocathode passes through the vicinity of the center of the electron lens at the cathode side. Therefore, the difference in the focusing action is small compared with the case wherein the electrons pass along the trajectory 30 (a central axis of the photocathode). The focusing surface of the entire photocathode is very close to the plane of the phosphor screen 27, resulting in good image resolution.

Figure 4:
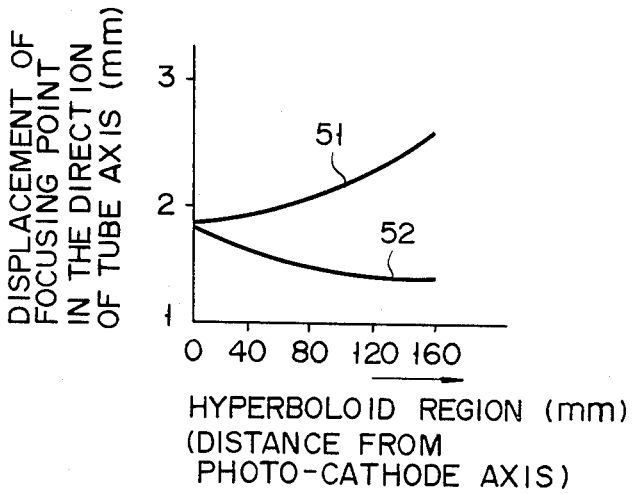
FIG. 4 is a graph for showing changes in errors of a focusing point along the tube axis as a function of a distance from the tube axis within a range of a hyperboloid.

The above facts were studied by simulation computation of electron trajectories and the results are shown in FIG. 4. FIG. 4 is a graph wherein a deviation in a focusing point along the tube axis is plotted as a function of a change in an area (distance from the axis of the photocathode) of the curved surface of the photocathode which comprises a hyperboloid. Referring to FIG. 4, a curve 51 shows the case wherein the entire surface of the photocathode is observed as the input field of view. A curve 52 shows the case wherein a central region with a width 7/10 the diameter of the photocathode is observed as the input field of view. It can be seen from FIG. 4 that when the entire surface of the photocathode comprises a hyperboloid, i.e., when the hyperboloid covers 167 mm from the center of the photocathode, and when the entire surface of the photocathode is observed as the input field of view, the error in the focusing point is 2.6 mm. In this case, when the central region of the photocathode, i.e., 7/10 of the diameter thereof, is observed as the input field of view, the error in the focusing point is 1.4 mm. When the entire surface of the photocathode comprises a spherical surface, i.e., when no region comprises a hyperboloid, and when the entire surface of the photocathode is observed as the input field of view, the error in the focusing point is 1.9 mm. In this case, when the central region having a diameter of 7/10 the diameter of the photocathode is observed as the input field of view, the error in the focusing point is 1.8 mm. In this manner, according to a conventional X-ray image tube wherein the entire surface of the photocathode comprises a hyperboloid or spherical surface, the error in the focusing point is extremely large when the entire surface of the photocathode is observed as the input field of view or when the central region of the photocathode is observed as the input field of view. Therefore, no single conventional X-ray tube can provide good resolution in both cases.

In contrast to this, when the central region having a diameter of 7/10 the diameter of the photocathode comprises a hyperboloid and the remaining surrounding region comprises a spherical surface, i.e., when the hyperboloid covers 117 mm in diameter of the photocathode, and when the entire surface of the photocathode is observed as the input field of view, the error in the focusing point is 2.3 mm. In this case, when the central region, i.e., 7/10 of the diameter of the photocathode, is observed as the input field of view, the error in the focusing point is 1.4 mm. As has been mentioned hereinabove, according to the X-ray image tube of the present invention, the error in the focusing point is small both in the case wherein the entire surface of the photocathode is observed as the input field of view and the case wherein only the central region thereof is observed as the input field of view. Therefore, the X-ray image tube according to the present invention can be conveniently used when both the entire surface and its central region only are used as input fields of view.

What is claimed is:

1. An X-ray image tube comprising: a vacuum envelope; a photocathode arranged at an input side in said vacuum envelope and having a curved surface open to an output side thereof; and a phosphor screen arranged at an output side in said vacuum envelope and having a surface on which electrons emitted from said photocathode are electrooptically focused, wherein said photocathode comprises a central surface region with a diameter which is $\frac{1}{2}$ to 4/5 of the diameter of the photocathode and a peripheral surface region, said central surface region has a profile such that an increment of the meridional curvature radius from said center to a peripheral portion thereof is larger than a constant derived from a linearity between the increment and a distance from the axis of said photocathode, and said peripheral surface region has a profile such that an increment of the meridional curvature radius from an inner peripheral portion to an outer peripheral portion is smaller than the constant derived from a linearity between the increment and the distance from the axis of said photocathode.

2. A tube according to claim 1, wherein said central surface region comprises a hyperboloid and said peripheral surface region comprises a spherical surface.

3. A tube according to claim 1, wherein said peripheral surface region comprises a profile such that the meridional curvature radius from the inner peripheral portion to the outer peripheral portion thereof is decreased in accordance with the distance from the axis of said photocathode.

4. A tube according to claim 3, wherein said central surface region comprises a hyperboloid and said peripheral surface region comprises a part of an elliptic surface.

5. A tube according to claim 1, wherein said central surface region and said peripheral surface region are tangentially connected.

* * * * *